United States Patent [19]

Vall

[11] 4,350,108

[45] Sep. 21, 1982

[54] AUTOMATIC TRAVELLER TENDER

[76] Inventor: Seymour Vall, 35 W. 81 St., New York, N.Y. 10024

[21] Appl. No.: 203,229

[22] Filed: Nov. 3, 1980

Related U.S. Application Data

[63] Continuation-in-part of Ser. No. 9,126, Feb. 5, 1979, Pat. No. 4,231,308.

[51] Int. Cl.[3] ..... B63H 9/10

[52] U.S. Cl. ..... 114/102; 114/205

[58] Field of Search ..... 114/39, 102, 104, 204, 114/205, 105, 112, 213; 267/156

[56] References Cited

U.S. PATENT DOCUMENTS

| | | | |
|---|---|---|---|
| 156,039 | 10/1874 | Poole | 114/205 |
| 2,963,287 | 12/1960 | Zoerb | 267/156 |
| 3,090,340 | 5/1963 | McCutchen et al. | 114/102 |
| 3,534,700 | 10/1970 | Marshall | 114/204 |
| 4,080,919 | 3/1978 | Holland et al. | 114/204 |

*Primary Examiner*—Sherman D. Basinger

[57] ABSTRACT

For a sailboat, a constant force spring reel is used to balance the force in a control line used to establish the angle of the sail with respect to the boat. The spring exerts an essentially constant force on the control line whereby the sail is allowed to move to leeward or windward in response to wind changes to maintain an essentially constant sail force on, and angle of heel of, the boat.

4 Claims, 4 Drawing Figures

AUTOMATIC TRAVELLER TENDER

BACKGROUND OF THE INVENTION

This application is a continuation-in-part of my copending application Ser. No. 009,126, filed Feb. 5, 1979 now U.S. Pat. No. 4,231,308, entitled "Sailing Vessel Self-Steerer". In that specification is disclosed a so-called "constant force" spring reel which is used to balance a pull in a steering line which is attached to a sail or sheet in such a way that the tension in the steering line is responsive to changes in the force exerted by the wind acting on the sails. The reel is arranged to utilize those changes in wind force due to changes in wind speed or direction to steer the boat to maintain an essentially constant heading of the boat with respect to the wind.

The angle of heel (tilt away from the wind) of a sailboat is adjusted by the position of the sails. A sailboat is perfectly balanced when its angle of heel produces a neutral helm. In this balanced condition it will maintain its heading without the need for rudder correction. However, under actual sailing conditions, the wind velocity (direction or speed or both) continually changes resulting in changes in the angle of heel. Changes in heel cause changes in heading which require rudder correction. Large changes in wind velocity require large rudder corrections and ultimately require a change in the position of the sails. Compensation for changes in wind velocity require the constant attention and exertion of the crew. It is a practical impossibility for the crew to make all the compensations necessary to always maximize sailing efficiency. Thus, the crew normally opts for an angle of heel which produces a tendency to turn toward the wind and requires a constant rudder correction. Rudder corrections slow the boat and therefore should be minimized. Rudder corrections can be minimized by changing the angle of the sail; easing the sail to leeward upon an increase in velocity and hauling it toward the weather side upon a decrease. The angle of the sail can be adjusted by tending the sheet, but a change in sheet tension also causes a change in shape of the sail. The angle of the sail also can be adjusted by changing the athwarthship position of the moveable traveller car to which the sheet is attached. Changing the position of the traveller car does not much affect sail shape and thus is a more desirable means for making corrections in heel.

Proper, continual adjustment of the athwartship position of the traveller car will maintain the angle of heel nearly constant and remove heel as a factor affecting heading, thereby lessening the need to correct heading by rudder movement. The result is far less rudder movement and a sail which is trimmed to the angle of the wind for maximum efficiency. However, continual adjustment of the traveller requires instantaneous response by the crew changes in wind. It is impractical to expect the crew to react instantaneously to wind changes.

SUMMARY OF THE INVENTION

The present invention utilizes a "constant force" spring reel or reels to sense wind changes and adjust the athwarthship position of the moveable car of a sheet traveller, particularly the mainsheet traveller, to permit the traveller to move leeward upon increase in wind force and to move windward upon a decrease in wind force.

The "constant force" spring reel is rigged to exert the desired essentially constant force to windward on the sheet traveller car. An increase in wind force on the sail causes the traveller car to move to leeward to the point where the sail once again exerts the established force on the boat. Conversely, a decrease in wind force on the sail causes the traveller car to move to weather in response to the spring reel force. Thus, the angle of the sail with respect to the boat changes to maintain the proper angle with respect to the changing wind, thereby maintaining an essentially constant angle of heel. This constant attention to the sail angle is automatic and greatly lessens the need for rudder movement.

DESCRIPTION OF THE INVENTION

The present invention positions a traveller car for a sheet such as a mainsheet by balancing the athwarthship component of the force exerted by the sheet against a "constant force" spring reel to thereby allow the traveller car to move to windward or leeward in response to the changes in wind velocity (speed or direction or both).

Figure 1:
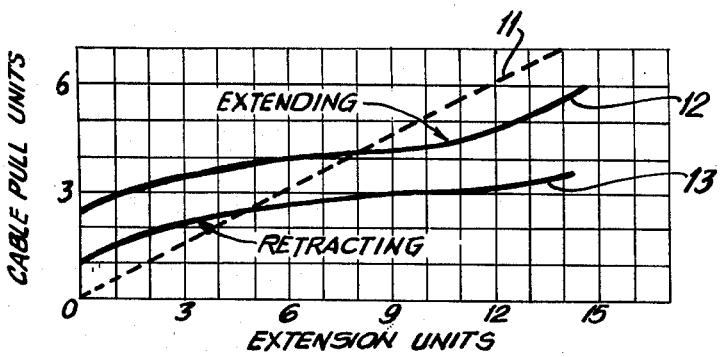
FIG. 1 is a plot of extension versus pull for a "constant force" spring reel and for a conventional spring.

FIG. 1 shows a typical force-displacement curve or a "constant force" spring reel as well as the linear curve of a conventional spring. As is readily apparent, the "constant force" spring does not follow Hooke's law. Hooke observed that a normal spring extends or compresses an equal incremental distance for each equal increment of force. This linear relationship of a normal spring is shown in FIG. 1 as the dashed straight line function 11. In this instance, a cable pull force increment of three units causes an extension of six units and a force increment of six units will cause an extension of twelve units for the normal Hooke's law spring. The "constant force" spring, however extends (curve 12) and retracts (curve 13) a great distance with very small incremental change in force. In FIG. 1, the constant force spring exerts about four (plus or minus one) force units over an extension range of between about one to thirteen units. This nearly constant force over a wide extension range makes these springs useful for such applications as counter-balancing most of the weight of a power tool used in factory assembly or the weight of the operating head of a device such as a photo enlarger or hospital X-ray machine. Reel-type constant force springs are available from Ametek, Hunter Spring Division, Hatfield, Pa., under the trademark "NEG'ATOR" constant force springs. A spring force of about 40 pounds is appropriate for daysailers and small cruising boats.

Figure 2:
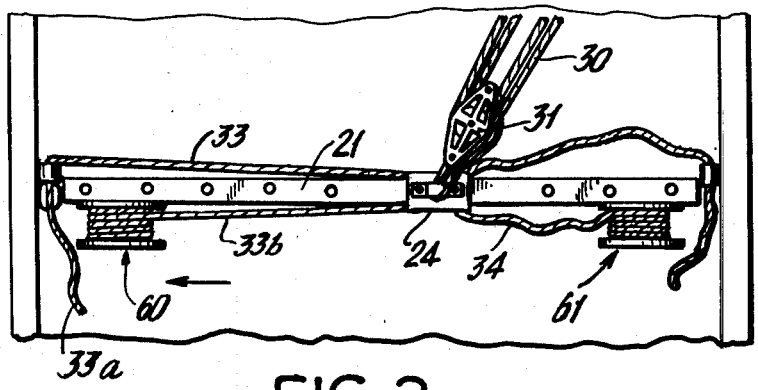
FIG. 2 is a plan view of the portion of a sailboat having a sheet traveller and showing an application of present invention.
Figure 3:
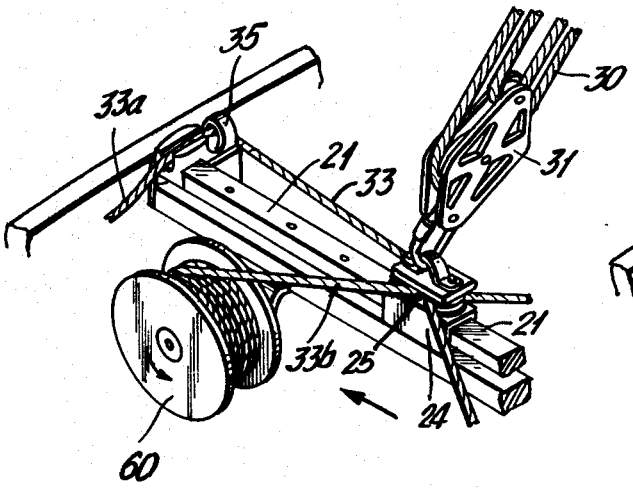
FIG. 3 is a perspective view toward the windward side of a sailboat showing an application of the present invention.

FIG. 2 is a plan view looking down on a portion of a sailboat and FIG. 3 is a partial perspective view looking toward the windward side of the boat. A traveller track 21 extends athwarthship and carries a moveable car 24 to which is attached the sheet block 31 of a sheet 30 such as a mainsheet. The windward side of the boat is indicated by an arrow. Wind force on the sail acts on the sheet 30 having a tendency to move the traveller car 24 to leeward. Leeward movement of the traveller car is counterbalanced by a traveller control line 33 rove through the car 24 about a small sheave 25. The free part 33*a* of the control line 33 is adjustably secured with a jamb or cam cleat 35 on the windward side. The other part 33*b* of the control line is taken up by winding about a reel 60 containing a constant force spring which exerts a pull on the traveller control line 33 to retard leeward movement of the traveller car.

The athwarthship position of the traveller car is set for the sailing conditions by hauling in or paying out the free part 33*a* of the weather traveller control line 33 until the car is properly positioned for the heading and conditions and then securing the free part 33*a* in the cleat 35. A similar traveller control line 34 and reel 61 are left slack on the leeward side ready for use on the other tack. An increase in sail force due to an increase in wind velocity exerts a greater force to leeward on the traveller car than the balancing force established by the spring 60 and the adjustment of the cleated part 33*a* of the control line 33. The car moves to leeward, thereby altering the angle of the sail to the wind reducing sail force, until the pre-established balanced force condition is restored. A drop in wind velocity reduces the leeward force on the car allowing the spring 60 to retract the car to windward again changing the sail angle until the balance is restored. The car 24 moves to windward and leeward of its established position under the influence of the control line 33 and constant force spring reel 60 to maintain the sail force essentially constant, thereby maintaining angle of heel essentially constant. Keeping the force exerted by the sail and the angle of heel essentially constant causes the boat to maintain a more constant heading and reduces or eliminates the need for rudder movement to compensate for the continual variations in the wind. Since it is the traveller car 24 which moves to trim the sail rather than alteration in the sheet tension, the set or shape of the sail is preserved. Preservation of sail shape coupled with a reduction of rudder movement contributes to sailing efficiency and hull speed.

Substitution of a conventional, i.e. Hooke's law, spring for the constant force spring used in the present invention does not achieve the same result. An increase in the force exerted by the sail would move the traveller car to leeward extending the conventional spring with its concomitant increase in restoring force until a new balance at a higher force was achieved. The higher force would increase heel. The essentially constant force of the spring of the present invention allows the traveller car to move to leeward until the sail angle change causes a reduction in sail force to that initially established, thereby resulting in the same force and heel angle.

Figure 4:
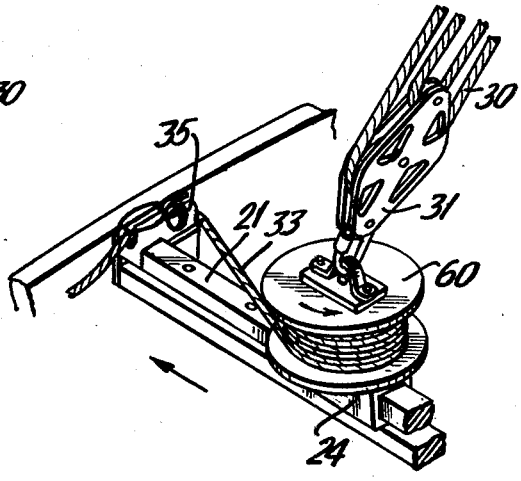
FIG. 4 is a view similar to FIG. 3, but showing a different embodiment of the present invention.

FIG. 4 shows another embodiment of the present invention wherein the constant force reel 60 is carried by the traveller car 24 and the control line 33 is secured to a jamb or cam cleat 35. This embodiment functions in the same way as that of FIGS. 1 and 2 although it does not have the pulley mechanical advantage of the first embodiment. A higher force spring reel can be used to compensate. Alternatively, the balance line can pass about a sheave located near the windward end of the traveller and back to be fastened to the car 24.

Changing tack with the embodiment of FIGS. 1 and 2 merely requires adjustment of the new weather control line 34. With the embodiment of FIG. 4, the control line is released, moved to the new weather side, and adjusted.

Other locations and rigging arrangements of the invention are possible and may be necessary for particular boats having traveller locations and arrangements dissimilar from that illustrated. The automatic traveller tender herein described can be used in concert with the self-steerer disclosed in my co-pending application Ser. No. 009,126.

Some, but not all, of the benefits of the present invention can be utilized in a boat lacking a moveable traveller car. The constant force spring can be rigged to control sheet tension to pay out and haul in sheet in response to variations in wind force.

I claim:

1. An automatic sail tending system for a sailboat to maintain a constant heeling force of the sail acting on the boat during variations in wind force which system comprises a control line for controlling the angle of the sail with respect to the boat, a constant force spring reel, and means to correct adjustably the spring reel and the control line to establish a predetermined sail angle, the spring reel acting to balance the force in the control line to allow the sail to move to leeward upon an increase in wind force and to move to windward upon a decrease in wind force to adjust the sail angle to provide a constant sail heeling force.

2. The sail tending system of claim 1 wherein the control line is a line on the windward side of a traveller car which is moveable athwarthships.

3. The sail tending system of claim 2 wherein the control line extends from a cleat on the windward side of the boat, about the traveller car, and back to windward to the constant force spring reel and wherein a similar control line, cleat and spring reel are provided on the leeward side of the boat for use on the other tack.

4. The sail tending system of claim 2 wherein the spring reel is carried by the traveller car.

* * * * *